United States Patent [19]

Carlson et al.

[11] 4,181,125

[45] Jan. 1, 1980

[54] PORTABLE TRACTION DEVICE

[76] Inventors: Richard C. Carlson, Box 262; Gary R. Van Vleet, Box 64, both of Beach, N. Dak. 58621

[21] Appl. No.: 839,404

[22] Filed: Oct. 5, 1977

[51] Int. Cl.[2] ..... A61H 1/02

[52] U.S. Cl. ..... 128/75; 128/84 C

[58] Field of Search ..... 128/75, 84 C, 83

[56] References Cited

U.S. PATENT DOCUMENTS

| | | | |
|---|---|---|---|
| 2,718,886 | 9/1955 | Sutton | 128/84 C |
| 2,796,061 | 6/1957 | Miller | 128/75 X |
| 3,654,921 | 4/1972 | Neuhardt, Jr. | 128/75 |
| 3,856,003 | 12/1974 | Pfluger | 128/75 |

FOREIGN PATENT DOCUMENTS

| | | | |
|---|---|---|---|
| 17274 | of 1908 | United Kingdom | 128/84 C |

*Primary Examiner*—John D. Yasko

*Attorney, Agent, or Firm*—Schroeder, Siegfried, Ryan, Vidas, Steffey & Arrett

[57] ABSTRACT

A portable traction device incorporating a simple and quickly-attachable frame adapted to be positioned on the frame of a patient transport cot for the application of traction force to a patient during transport. The traction device includes a base frame or U-shaped bracket member which fits around the frame of a cot and includes flanges thereon to mount the bracket member on either end of a transport cot. The bracket member has suitable guide sleeves therein and a U-shaped pulley bar is adjustably positioned in the guide sleeves of the bracket member. Adjustably positioned pulleys are mounted on the pulley bar such that through the use of appropriate slings, traction force may be directed to the limbs, pelvis or cervical neck regions of the patient being transported to provide a traction force to the patient during transport.

6 Claims, 2 Drawing Figures

PORTABLE TRACTION DEVICE

FIELD AND BACKGROUND OF INVENTION

This invention relates to a portable traction device which may be simply and quickly attached to a portable patient transfer cot to enable uninterrupted application of traction to patients during transport.

Traction devices used for applying a pulling force to various portions of the human body for medical treatment are well recognized. Generally such structures are bolted or otherwise secured to hospital beds, treatment tables or the like. In the past, such structures which have been called portable have been generally complex in design and have required fairly complex methods of attaching the same to the support upon which a patient is positioned. In certain instances, such portable units have incorporated supporting cot or complex frames to be attached thereto. As such, they are not readily applicable for use by ambulance personnel in the transport of patients or are not readily adaptable for use in connection with litters or cots used for transport of patients in ambulances.

SUMMARY

The present invention is directed to an improved portable traction device especially designed to give ambulance personnel a simple, quickly-attachable device for applying uninterrupted traction to patients during transport. The improved portable traction device fits onto either end of a typical patient transfer cot, such as a Ferno-Washington cot, and with appropriate slings will apply the desired tension to lower limbs, pelvis or cervial neck areas of the patient. The improved portable traction device incorporates a base frame or bracket member which readily slides onto the frame of the transport cot and tilts down to lock it into place and secure the same to the cot. A pulley bar is adjustably positioned into the base or mounting bracket and is adjustable vertically to vary the direction of application of force to the patient. One or more pulleys are adjustably mounted on the pulley bar to insure the proper direction and application of force to the patient.

DESCRIPTION OF PREFERRED EMBODIMENT

Figure 1:
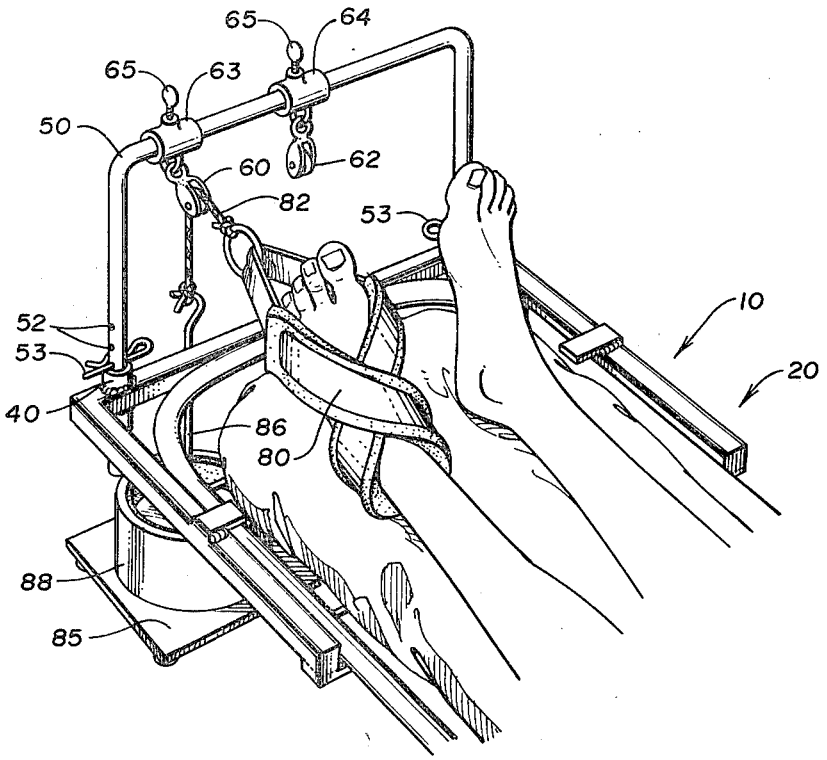
FIG. 1 is a perspective view of a portion of a transport cot with the improved portable traction device attached thereto and showing an application of force to the limb of a patient.
Figure 2:
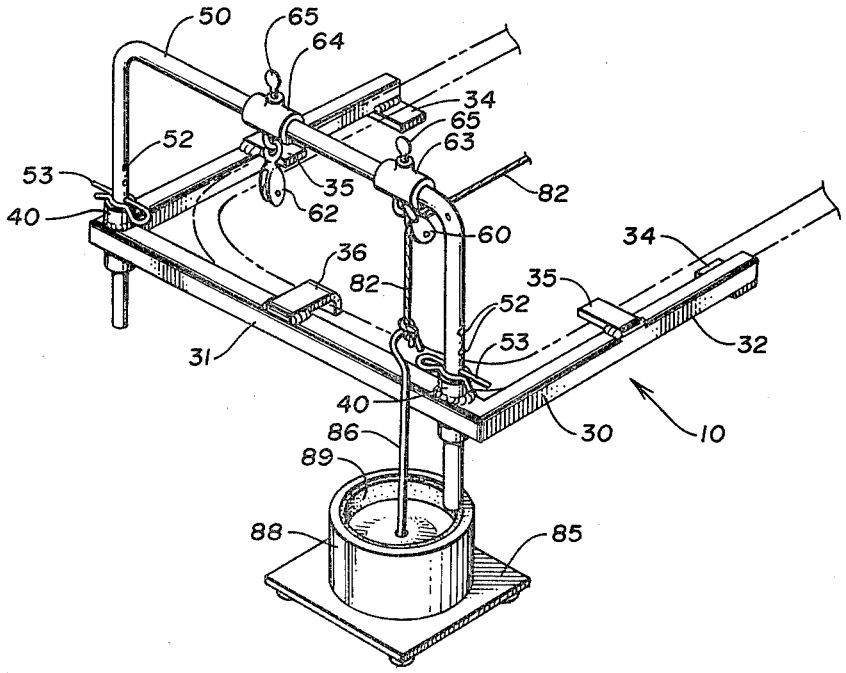
FIG. 2 is a perspective view of the portable transport device at another angle showing the cot in phantom and disclosing details of the same.

The improved portable traction device is shown in the drawing in FIGS. 1 and 2 generally at 10 as applied to or connected to a portion of the frame of a patient transport cot, indicated generally at 20. Although only a portion of the cot is shown, it will be understood that it is of the type conventionally used for transporting patients in ambulances, such as a Ferno-Washington cot, and that such cots have suitable wheel structures, (not shown) supporting the same. Such cots have a generally horizontal tubular frame section and the improved traction device may be applied to either end of the cot depending upon the application of traction to the patient thereon. Similarly, it will be understood that the patient is suitably supported on the cot and secured thereon through straps.

As will be seen in FIGS. 1 and 2, the portable traction device includes a base or frame bracket member 30 which is generally U-shaped in form. It is preferably constructed as a metallic tubular member which is generally square in cross section and has dimensions similar to the tubular dimension of the cot frame. The base or U-shaped bracket has a base portion 31 and leg portions 32 formed integral therewith with the leg portions having flanges 34 and 35 thereon. The flanges of the leg portions face inwardly toward the opposite leg portion. The base and leg portions of the bracket are of such length or dimension as to conveniently fit around the frame of the cot such that the leg portions will be postioned adjacent the same. The metal flanges 34 and 35 on the leg portions are suitably welded thereto. The flanges 34 on the ends of the leg portions are positioned on the lower sides of the leg portions such as to be positioned on the under side of the cot frame. Similarly, the flanges 35 intermediate the ends of the legs and the base portion 31 are postioned on the top of the leg portions to be positioned on the top side of the cot frame. The U-shaped bracket member or base frame is readily applied to the end of a cot frame by tilting the bifurcated extremity down such that the end flanges 34 are beneath the frame and the intermediate flanges 35 are above the frame. The bifurcated ends of the bracket will be aligned with and slide along the sides of the cot frame so that the base portion 31 may be positioned to any desired spacing with respect to the cot frame. By tilting the bracket member down, the flanges 34 and 35 contact the frame and when the leg portions 32 are substantially parallel with the cot frame 20, the traction device 10 is retained, and secured against movement with respect to the cot frame 20. Also included on the base portion 31 of the bracket member is an additional flange 36 which is suitably welded to the top of the bracket portion and located centrally thereof. The flange 36 has a down-turned extremity which may be fitted around the end of the cot frame or a sliding bar section mounted thereon, if desired, as will be best seen in FIG. 2.

The base frame or U-shaped bracket member has a pair of apertures positioned near the corners of the base portion 31 and suitable cylindrical sleeve members 40 are positioned therein and suitably secured thereto, such as by welding. A pulley bar 50 which is formed of tubular metal and bent to a U-shaped configuration has its ends or leg portions positioned to freely slide in the sleeve members 40 of the bracket. The pulley bar has a series of apertures 52 drilled through the leg portions of the pulley bar so that the height of the base of the pulley bar may be adjusted relative to the bracket member. Suitable pins or cotter keys 53 positioned in the apertures 52 hold the pulley bar at an adjusted height with respect to the sleeve members 40. The top or base of the pulley bar supports a pair of pulley members 60 and 62 which pulley members are pivotally attached to sleeves 63, 64 slidably mounted on the pulley bar and adjustably positioned thereon and locked in position through thumb screw locks 65. The sleeves 63 and 64 and hence the pulleys 60, 62 are horizontally adjustable relative to the base frame to align the pulleys 60 and 62 with the extremity of the patient to which the traction force is to be applied. The improved portable traction device is very simply and readily attached to a patient transport cot without the requirement of bolting or otherwise securing the same to the patient support. It is particularly applicable to applying uninterrupted traction to patients during ambulance transport and is readily adapted for use with transport cots of this type. The pulley bar is adjusted relative to the main support bracket vertically to position the pulleys such that the traction force may be applied to the patient in the proper direction. Similarly, the pulleys are adjustable relative to the pulley bar to align the application of force in the proper direction. The traction force is applied through appropriate slings attached to the patient's extremities to provide the desired tension to the lower limbs, pelvis or cervical neck regions of a transport. As indicated in FIG. 1, a sling 80 attached to a patient's foot is connected through a rope 82 directed across pulley 60 to a traction weight 86 connected to the rope through a suitable hook type connector. During transport, the weight is positioned in a stand formed of a base plate 85 and an upstanding cylindrical housing 88 welded thereto, the housing having an internal rubber padding 89 therein to dampen movement of the weight and prevent jars through the sling to the patient.

In considering this invention it should be remembered that the present disclosure is illustrative only and the scope of the invention should be determined by the appended claims.

What we claim is:

1. A portable traction device adapted to be mounted on a portable patient transfer cart comprising, a U-shaped bracket member having a base portion and leg portions each having dimensions adapted to fit over the end of the frame and along the longitudinal members of the portable patient transfer cot, said leg portions having flanges extending transversely therefrom at the ends of the leg portions and intermediate the ends of the leg portions and the base portion of the bracket member, said flanges being adapted to engage the frame of the cot and retain the bracket member thereon against movement, a pair of apertures positioned in the base portion of the bracket member near the leg portions thereof, and a U-shaped pulley bar having its legs releasably mounted in the apertures in the base portion of the bracket member and extending normal thereto, said pulley bar having pulley means which are movable transversely with respect to the base portion of the bracket member.

2. The portable traction device of claim 1 in which the apertures in the base portion of the bracket member have guides therein through which the legs of the pulley bar are positioned.

3. The portable traction device of claim 2 in which the legs of the U-shaped pulley bar have adjustment apertures distributed along the same and removable pin means selectively positioned through said apertures to adjust the vertical position of the pulley bar relative to the bracket.

4. The portable traction device of claim 3 in which the pulley means on the pulley bar are a pair of pulley members mounted on sleeves slidably mounted on the pulley bar.

5. The portable traction device of claim 1 in which the flanges at the ends of the leg portions are adapted to engage the underside of the cot frame and the intermediate flanges are adapted to engage the upper side of the cot frame.

6. The portable traction device of claim 5 and including additional flange means positioned on said base portion of the bracket member to engage the upper side of the end of a cot frame.

* * * * *